US008492656B2

(12) United States Patent
Martinez et al.

(10) Patent No.: US 8,492,656 B2
(45) Date of Patent: Jul. 23, 2013

(54) HIGH VOLTAGE BUSHING

(75) Inventors: Rolando Martinez, Clifton Park, SC (US); James Jun Xu, Niskayuna, NY (US); Lin Zhang, Shanghai (CN)

(73) Assignee: General Electric Company, Schenectady, NY (US)

( * ) Notice: Subject to any disclaimer, the term of this patent is extended or adjusted under 35 U.S.C. 154(b) by 303 days.

(21) Appl. No.: 12/876,374

(22) Filed: Sep. 7, 2010

(65) Prior Publication Data

US 2012/0055696 A1 Mar. 8, 2012

(51) Int. Cl.
*H01B 17/26* (2006.01)

(52) U.S. Cl.
USPC ..... 174/152 R; 174/11 BH; 174/14 BH; 174/142

(58) Field of Classification Search
None
See application file for complete search history.

(56) References Cited

U.S. PATENT DOCUMENTS

| | | | | | |
|---|---|---|---|---|---|
| 4,312,123 | A | * | 1/1982 | Wheeler | 29/887 |
| 4,431,886 | A | * | 2/1984 | Logan | 218/1 |
| 4,488,072 | A | | 12/1984 | Archibald et al. | |
| 4,540,848 | A | | 9/1985 | Beijar et al. | |
| 4,562,321 | A | * | 12/1985 | Bolongeat-Mobleu et al. | 218/57 |
| 4,965,407 | A | * | 10/1990 | Hamm | 174/31 R |
| 5,015,895 | A | * | 5/1991 | Obley | 310/71 |
| 5,069,525 | A | * | 12/1991 | Seike et al. | 385/100 |
| 5,279,365 | A | * | 1/1994 | Yenulis et al. | 166/84.3 |
| 5,387,448 | A | * | 2/1995 | Watanabe et al. | 428/34.7 |
| 5,466,891 | A | * | 11/1995 | Freeman et al. | 174/142 |
| 5,483,023 | A | * | 1/1996 | Barnes | 174/152 R |
| 5,808,858 | A | * | 9/1998 | Vetter | 361/519 |
| 6,150,613 | A | * | 11/2000 | Bergstrom | 174/152 R |
| 6,164,521 | A | * | 12/2000 | Mellon | 228/164 |
| 6,289,790 | B1 | * | 9/2001 | Rey | 92/170.1 |
| 6,515,232 | B2 | * | 2/2003 | Forster | 174/152 R |
| 6,815,608 | B2 | * | 11/2004 | Sato et al. | 174/11 BH |
| 6,856,059 | B2 | * | 2/2005 | Stewart et al. | 310/89 |
| 7,017,437 | B1 | * | 3/2006 | Zernickel et al. | 74/89.42 |
| 7,155,989 | B1 | * | 1/2007 | Gerold et al. | 73/863.85 |
| RE39,840 | E | * | 9/2007 | Baker et al. | 174/142 |
| 8,222,526 | B2 | * | 7/2012 | Bresney et al. | 174/152 R |
| 2001/0022235 | A1 | * | 9/2001 | Villa et al. | 174/167 |
| 2002/0040806 | A1 | * | 4/2002 | Baker et al. | 174/142 |
| 2002/0074156 | A1 | * | 6/2002 | Forster | 174/167 |
| 2002/0121390 | A1 | * | 9/2002 | Alznauer et al. | 174/152 R |
| 2004/0094327 | A1 | * | 5/2004 | Sato et al. | 174/137 R |
| 2005/0016752 | A1 | * | 1/2005 | Hiroshi et al. | 174/73.1 |
| 2007/0137881 | A1 | * | 6/2007 | Ashibe | 174/125.1 |
| 2010/0018002 | A1 | * | 1/2010 | Bresney et al. | 16/2.2 |
| 2010/0258347 | A1 | * | 10/2010 | Roseen et al. | 174/668 |

FOREIGN PATENT DOCUMENTS

GB 1020578 A 2/1966

OTHER PUBLICATIONS

Search Report issued in connection with GB Patent Application No. 1114574.5, Jan. 23, 2012.

* cited by examiner

*Primary Examiner* — Hoa C Nguyen
*Assistant Examiner* — Xanthia C Cunningham
(74) *Attorney, Agent, or Firm* — Nixon & Vanderhye, P.C.

(57) ABSTRACT

A high voltage bushing assembly includes an insulator shell adapted to enclose an electrical conductor. An annular flange is slidably received over the insulator shell, the annular sleeve formed with a radially outwardly directed flange at an upper end and a radially inwardly directed flange at a lower end, with a sleeve portion extending axially therebetween. The insulator shell has an outside diameter and the sleeve portion has an inside diameter sized to create an annular, radial gap therebetween filled with a high thermal endurance fiberglass-reinforced epoxy resin.

10 Claims, 3 Drawing Sheets

HIGH VOLTAGE BUSHING

BACKGROUND OF THE INVENTION

This invention relates generally to large generator constructions, and specifically to a high voltage bushing utilized to pass an electrical conductor through a wall of a generator frame.

A high voltage bushing is used for passing an electrical conductor through a pressure vessel wall of, for example, a large generator, the conductor carrying electricity out of the generator to voltage and power transformers and then to an electrical grid or the like. It is important that such bushings prevent a cooling gas (e.g., hydrogen) inside the pressurized vessel (stator) from leaking out of the vessel through the bushing stator wall interface. In addition, the conductor must be electrically insulated from the pressurized vessel or stator wall. This is achieved by enclosing the conductor inside a porcelain or other insulating sleeve or shell. An annular, sleeve-like metallic bushing also referred to herein as a "bushing flange") is telescoped over the exterior surface of the porcelain shell and is utilized to attach the porcelain sleeve to the pressure vessel wall. One such high voltage bushing flange is disclosed in commonly-owned U.S. Pat. No. 5,483,023.

Problems associated with such high voltage bushings include: 1) cracking of the porcelain sleeve due to mechanical stresses imparted by the thermally-mismatched bushing flange; 2) leaking of hydrogen gas from inside the generator stator through the bonding seals between the bushing flange and the porcelain shell; 3) micro crack formation of bonding materials induced by, for example, high density epoxies of virgin porosity, thermal-aging excess tensile stresses, thermal cycling, and/or vibrations experienced during operation.

There remains a need, therefore, for an improved high voltage bushing flange that alleviates excess tensile stresses on the porcelain shell for increased service longevity, and that more effectively blocks potential gas leakage pathways through the bonding seals utilized to provide a buffer between the metal bushing flange and the insulating shell such as, but not limited to, a porcelain shell.

BRIEF SUMMARY OF THE INVENTION

In accordance with an exemplary but non-limiting embodiment, the present invention relates to a high voltage bushing flange assembly comprising an insulator shell adapted to enclose an electrical conductor; an annular bushing flange slidably received over the insulator shell, the annular bushing flange formed with a radially outwardly directed flange at an upper end and a radially inwardly directed flange at a lower end, with a sleeve portion extending axially therebetween; the insulator shell having an outside diameter and the sleeve portion having an inside diameter sized to create an annular, radial gap between the insulator shell and the sleeve portion, the radial gap filled with a high thermal endurance fiberglass-reinforced epoxy resin, supported axially by the radially inwardly directed flange.

In another aspect, the present invention relates to a high voltage bushing assembly comprising an insulator shell adapted to enclose an electrical conductor; an annular bushing flange slidably received over the insulator shell, the annular bushing flange formed with a radially outwardly directed flange at an upper end thereof and an axially-oriented sleeve portion, the insulator shell having a substantially uniform outside diameter and the sleeve portion having a substantially conically-shaped inside surface sized to create an annular, conically-shaped radial gap between the insulator shell and the axially-oriented sleeve portion, the conically-shaped radial gap filled with a high thermal endurance fiberglass-reinforced epoxy resin.

In still another aspect, the invention relates to a bushing assembly comprising a substantially cylindrical shell; an annular bushing flange slidably received over the substantially cylindrical shell, the annular bushing flange formed with a radially outwardly directed flange at one end and a radially inwardly directed flange at an opposite end, with a sleeve portion extending axially therebetween; the substantially cylindrical shell having an outside surface and the sleeve portion having an inside surface sized to create an annular radial gap therebetween, the radial gap filled with a high thermal endurance fiberglass-reinforced epoxy resin between the radially outwardly directed flange and the radially inwardly directed flange, bonding the bushing flange to the substantially cylindrical shell.

The invention will now be described in detail in connection with the drawings identified below.

DETAILED DESCRIPTION OF THE INVENTION

Figure 1:
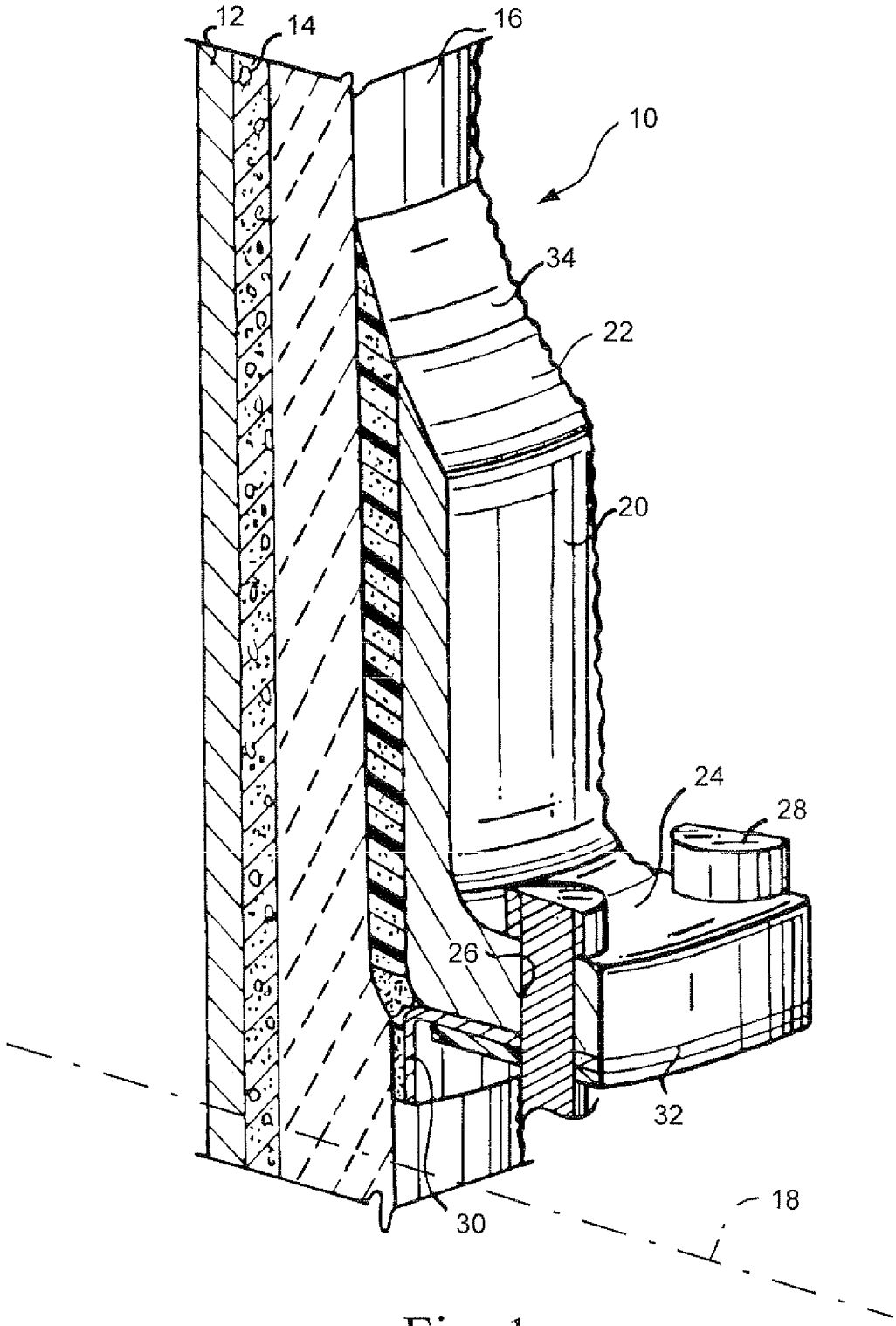
Fig. 1 (Prior Art)
FIG. 1 is a partial, sectioned perspective view of a known high voltage bushing flange.

With reference initially to FIG. 1, a known bushing flange 10 is shown enclosing a copper conductor 12 having a wrap 14 of asphalt or similar material between the conductor and a porcelain insulator sleeve or shell 16. A metal bushing flange (or simply, "flange") 10 is telescoped over the exterior of the porcelain shell 16 and is utilized to attach the porcelain shell 16 to the pressure vessel wall, indicated in phantom at 18. The bushing flange 10 includes an axial portion 20 terminating at a tapered edge 22 at one end, and a radial flange portion 24 at an opposite end of the axial portion 20. The radial flange portion 24 is provided with a plurality of axially oriented through holes 26 which enable the bushing 10 to be secured to the pressure vessel wall by means of bolts 28 or other suitable fasteners.

An annular support ferrule 30 is telescoped onto the shell 16 to a location where it abuts the radial portion 24 of the mounting flange 10. The ferrule 30 serves as a seal, preventing escape of hydrogen from inside the pressurized vessel where the bushing flange 10 is joined to the pressurized vessel wall. A gasket 32 extends over the exposed side of the ferrule radial portion and is adapted to be compressed between the ferrule 30 and the pressurized vessel wall.

The bushing flange 10 is secured to the porcelain insulator shell 16 by means of an epoxy 34 located in a radial gap between the axial portion 20 of the bushing flange 10 and the porcelain insulator shell 16.

Figure 2:
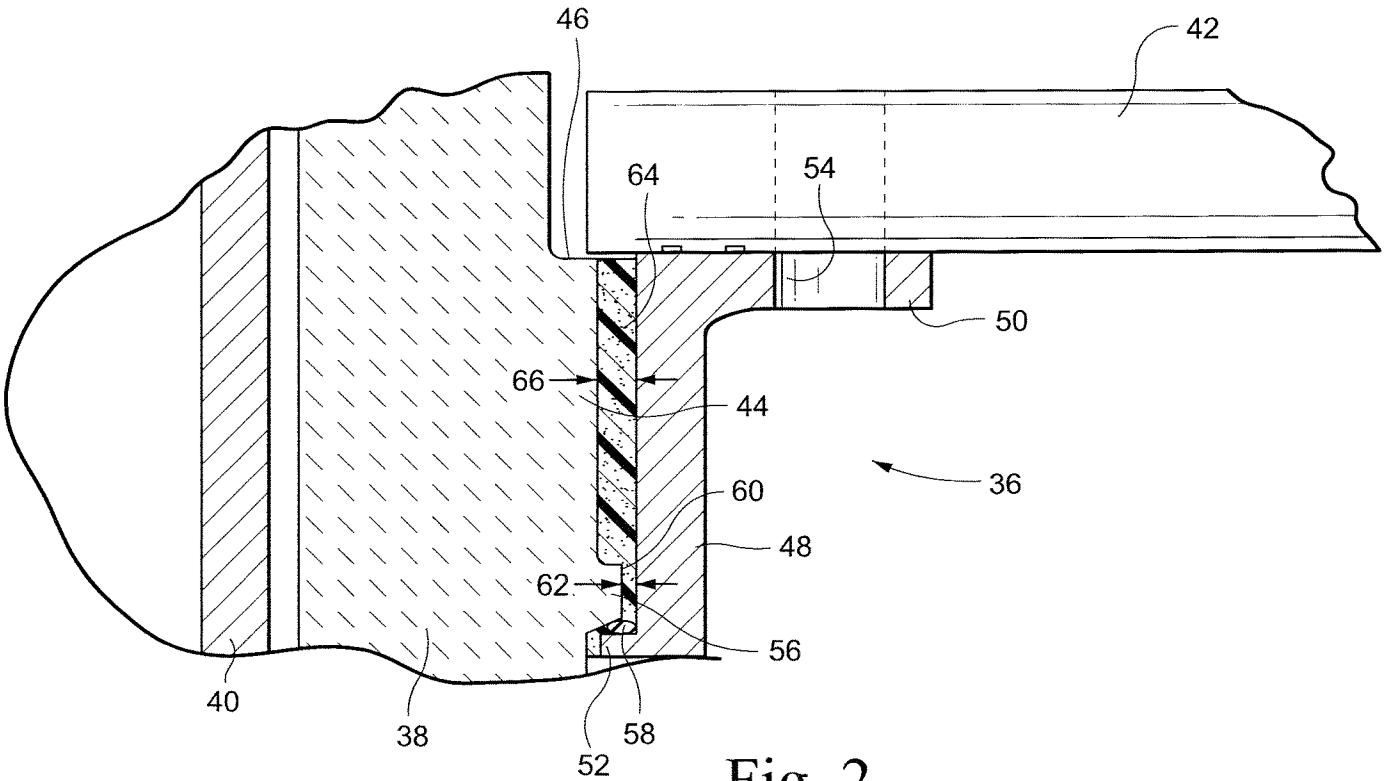
FIG. 2 is a partial section view of a high voltage bushing flange in accordance with a first exemplary but nonlimiting embodiment of the invention.

FIG. 2 illustrates a high voltage bushing flange in accordance with an exemplary but nonlimiting embodiment of the invention. An annular, non-magnetic, metal (steel alloy, for example) bushing flange 36 is shown telescoped over a porcelain insulator sleeve or shell 38 that encloses a copper conductor 40. The bushing flange 36 attaches the porcelain insulator shell to the wall of a generator stator frame 42. The flange 36 is located radially outwardly of an enlarged diameter portion 44 of the insulator shell, commencing at a radial shoulder 46, where the shell 38 projects through the stator frame wall.

The flange 36 includes an axial sleeve portion 48 and a radially outwardly directed flange portion 50 at one end thereof (the upper end as viewed in FIG. 2), and a smaller radially inwardly directed flange 52 at the opposite end thereof. The radially outwardly directed flange portion 50 is formed with a plurality of circumferentially spaced bolt holes (one shown) 54 that facilitate attachment of the flange 36 (and hence the porcelain insulator shell 38) to the wall of the generator stator frame 42 in an otherwise conventional fashion.

In this embodiment, the porcelain insulator shell 38 is formed with at least one annular rib 56 in the enlarged diameter portion 44 at a location above and adjacent the radially inwardly directed flange 52, with an axial gap sufficient to receive an o-ring 58 that is supported on the flange 52. The axial portion 60 of the annular rib 56 leaves only a very narrow pathway or radial gap 62 for potential hydrogen gas leakage, thereby improving the effectiveness of the O-ring 58. An epoxy bonding resin 64 fills both the narrow radial gap 62 and the relatively larger radial gap 66 (of about ½ inch in thickness) between the porcelain insulator shell 38 and the axial sleeve portion 48 of the flange 36. It will be understood that one annular rib 56 would be sufficient, but it can be more than one, and may be spaced along the portion 44 of the shell 38.

The epoxy resin 64 buffers the thermal expansion mismatch between the porcelain shell 38 and the metal flange 36 at high temperatures. Otherwise, the direct compression and tensile stresses of the brittle porcelain shell 38 by the sleeve portion 48 and radial portion 50 of the annular bushing flange 36 as a result of thermal mismatch could result in chip-off or micro-cracks formed in the porcelain sleeve. Note that the annular porcelain rib and the inwardly directed flange 52 also provide some axial support for, and thus reduce stress on, the epoxy bonding resin 64.

The epoxy bonding resin 64 must be high in mechanical strength and toughness for supporting the weight of the porcelain shell 38 and for absorbing the thermal mismatch between the porcelain shell 38 and the metal flange 36. In addition, it must have high thermal endurance capability and be void-free or void-less when cured. This is particularly important in the area of the narrow gap 62 where it is also a potential, high-pressure gas leakage pathway. Ordinary resins are subject to the formation of voids or bubbles caused by fast curing and skin effect, or by use of organic solvents or diluents that contain components that are readily trapped during the exothermal curing process.

In the exemplary embodiment, epoxy bonding resins such as ASTRO-6979 and ASTRO-6269 have proven suitable for bushing bonding application due to their lack of solvents which produce less porosity when cured. The utility of vacuum oven cure further reduces the bubble formation. The epoxy is reinforced with embedded fiberglass for increased bonding strength, increased mechanical strengths and a reduced coefficient of thermal expansion. As mentioned above, it is also important that the epoxy resin 64 be cured properly. The glass transition temperature should be between 90° C. and 120° C. so that flexibility and toughness are maintained. The thermal classification of said epoxy material should be Class 155 as per IEC 60216. This allows the epoxy bonding resins to have high thermal endurance capability to withstand the heat generated from the copper conductor (through the porcelain shell) as well as restive to heating due to Eddie currents induced on the flange. In one example the epoxy resin material may have the following properties:

TABLE I

| Epoxy Bonding Resin for Insulating Shell and Flange | Temperature Value |
|---|---|
| Thermal Indices ° C. | 155-179 |
| Glass Transition Temperature of Bonding resin (° C. ) | 90-120 |

Figure 3:
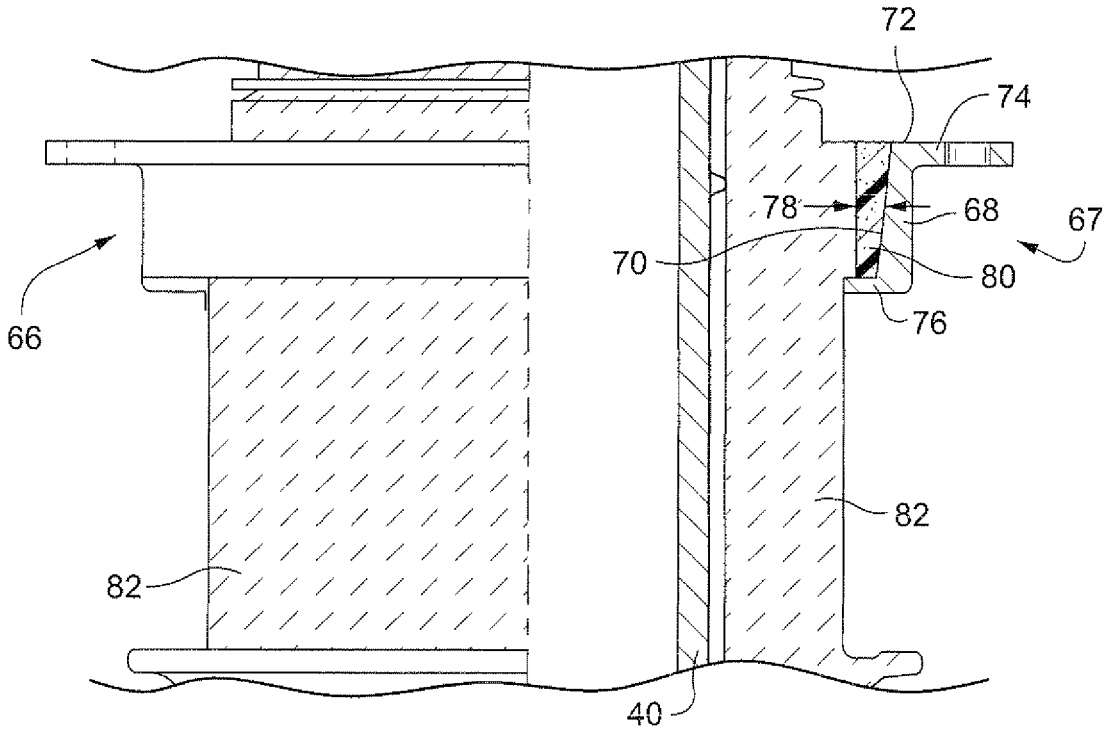
FIG. 3 is a partial section view of a high voltage bushing flange in accordance with a second exemplary but nonlimiting embodiment of the invention.

In a second exemplary but nonlimiting embodiment as illustrated in FIG. 3, a high voltage flange bushing 67 is generally similar to the bushing flange 36 described above, but the inside diameter of the flange 67 varies along the length of the axial sleeve portion 68. More specifically, the inside surface 70 is conical in shape, with the inside diameter decreasing substantially uniformly from the upper edge 72 of the flange portion 74 to the lower, radially inwardly-directed flange 76. The resulting tapered gap 78 is filled with an epoxy bonding resin 80 that may be the same as the epoxy resin 64 described above. This arrangement further reduces tensile and shear stresses resulting from bushing body gravity, pressures, as well as the thermal mismatch between the porcelain shell 82 and the bushing flange 67. While the annular rib 56 is omitted from FIG. 3, it will be understood that one or more such ribs 56 (and seal 58) may be included axially above the lower flange 76 of the bushing flange 67.

In both embodiments, the bushing flange and high thermal endurance epoxy seal alleviates the excess mechanical stresses on the porcelain shell; reduces the potential for cracks in the porcelain shell by buffering the thermal mismatch between the porcelain shell and the bushing flange; and, as a result of reduced porosity in the epoxy resin, prevents gas leakage through the bonding regions.

The invention is widely applicable through a full range of hydrogen-cooled generators rated 24 KV and below.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

We claim:

1. A high voltage bushing flange assembly comprising:

an insulator shell adapted to enclose an electrical conductor; an annular bushing flange slidably received over said insulator shell, said annular bushing flange formed with a radially outwardly directed flange at an upper end and a radially inwardly directed flange at a lower end, with a sleeve portion extending axially therebetween; said insulator shell having an outside diameter and said sleeve portion having an inside diameter sized to create an annular, radial gap between said insulator shell and said sleeve portion, said radial gap filled with a high thermal endurance fiberglass-reinforced epoxy resin, supported axially by said radially inwardly directed flange;

wherein said insulator shell is formed to include at least one annular radially outwardly-extending rib radially overlapping said radially inwardly directed flange; and wherein an annular seal is seated on said radially inwardly-directed flange and axially compressed between said at least one annular, radially outwardly-extending rib and said radially inwardly-directed flange.

2. The high voltage bushing assembly of claim 1 wherein said insulator shell has an enlarged diameter portion, a lower end of which terminates at said at least one annular rib.

3. The high voltage bushing assembly of claim 1 wherein said at least one annular, radially outwardly-extending rib creates a narrowed radial gap above said annular seal, said narrowed radial gap also filed with said high thermal endurance fiberglass-reinforced epoxy resin.

4. The high voltage bushing assembly of claim 1 wherein said high thermal endurance fiberglass-reinforced epoxy resin has material properties as set out in Table I.

5. A high voltage bushing assembly comprising:

an insulator shell adapted to enclose an electrical conductor; an annular bushing flange slidably received over said insulator shell, said annular bushing flange formed with a radially outwardly directed flange at an upper end thereof and an axially-oriented sleeve portion, said insulator shell having a substantially uniform outside diameter and said sleeve portion having a substantially conically-shaped inside surface sized to create an annular, conically-shaped radial gap between said insulator shell and said axially-oriented sleeve portion, said conically-shaped radial gap filled with a high thermal endurance fiberglass-reinforced epoxy resin, said resin flush with said radially outwardly directed flange.

6. The high voltage bushing assembly of claim 5 wherein said high thermal endurance fiberglass-reinforced epoxy resin has material properties as set out in Table I.

7. The high voltage bushing assembly of claim 5 wherein said annular bushing flange is formed with a radially inwardly directed flange at a lower end thereof supporting said high thermal endurance fiberglass-reinforced epoxy resin and engaged with said insulator shell.

8. The high voltage bushing assembly of claim 7 wherein said radially outwardly directed flange is provided with a plurality of holes adapted to receive a corresponding plurality of fasteners used to attach the bushing flange to a pressure vessel wall.

9. A bushing assembly comprising:

a substantially cylindrical shell; an annular bushing flange slidably received over said substantially cylindrical shell, said annular bushing flange formed with a radially outwardly directed flange at one end and a radially inwardly directed flange at an opposite end, with a sleeve portion extending axially therebetween; said substantially cylindrical shell having an outside surface and said sleeve portion having an inside surface sized to create an annular radial gap therebetween, said radial gap filled with a high thermal endurance fiberglass-reinforced epoxy resin between said radially outwardly directed flange and said radially inwardly directed flange, bonding said bushing flange to said substantially cylindrical shell, wherein said substantially cylindrical shell is formed to include at least one annular radially outwardly-extending rib radially overlapping said radially inwardly directed flange; and further wherein an annular seal is seated on said radially inwardly directed flange and axially compressed between said at least one annular, radially outwardly-extending rib and said radially inwardly directed flange.

10. The bushing assembly of claim 9 wherein said high thermal endurance fiberglass-reinforced epoxy resin has material properties as set out in Table I.

* * * * *

UNITED STATES PATENT AND TRADEMARK OFFICE

CERTIFICATE OF CORRECTION

PATENT NO. : 8,492,656 B2
APPLICATION NO. : 12/876374
DATED : July 23, 2013
INVENTOR(S) : Rolando Martinez et al.

It is certified that error appears in the above-identified patent and that said Letters Patent is hereby corrected as shown below:

In the Specifications:

At column 3, line 37, insert --56-- between --annular porcelain rib-- and --and the inwardly directed flange--

Signed and Sealed this
Seventeenth Day of September, 2013

Teresa Stanek Rea
*Deputy Director of the United StatesPatent and Trademark Office*